US005163690A

United States Patent [19]

Davis et al.

[11] Patent Number: 5,163,690

[45] Date of Patent: Nov. 17, 1992

[54] BIOPHYSICALLY CONTROLLED GAME SYSTEM

[76] Inventors: Dennis W. Davis, 10740 Eland St., Boca Raton, Fla. 33433; Keith C. Hyatt, 642 Tyler Run, Wake Forest, N.C. 27587; Russell D. Davis, 10740 Eland St., Boca Raton, Fla. 33433

[21] Appl. No.: 511,242

[22] Filed: Apr. 19, 1990

Related U.S. Application Data

[63] Continuation-in-part of Ser. No. 87,526, Aug. 20, 1987, abandoned, which is a continuation-in-part of Ser. No. 646,818, Sep. 4, 1984, abandoned.

[51] Int. Cl.[5] ..... A63F 9/24

[52] U.S. Cl. ..... 273/460; 273/433; 273/237

[58] Field of Search ..... 273/237, 433, 460, 85 G, 273/DIG. 28; 340/716, 752, 762, 782

[56] References Cited

U.S. PATENT DOCUMENTS

| | | | |
|---|---|---|---|
| 2,749,480 | 6/1956 | Ruderfer | 340/716 |
| 3,636,551 | 1/1972 | Maguire | 340/752 |
| 4,017,072 | 4/1977 | Kurtz | 273/483 |
| 4,086,514 | 4/1978 | Havel | 340/762 |
| 4,134,104 | 1/1979 | Karras | 340/782 |
| 4,149,716 | 4/1979 | Scudder | 273/438 |
| 4,339,135 | 7/1982 | Breslow et al. | 273/433 |
| 4,580,133 | 4/1986 | Matsuoka et al. | 340/762 |
| 4,754,202 | 6/1988 | Havel | 340/782 |

*Primary Examiner*—Vincent Millin
*Assistant Examiner*—Jessica J. Harrison

[57] ABSTRACT

A three-dimensional display system for co-spatial point display of information emanating from at least two biophysical sources. The system includes a rigid, transparent three-dimensional structure within which is provided co-spatial visual display elements arranged in a three-dimensional geometry at regular coordinate addresses. Information input terminals, including terminals for biological interface, are provided. Also furnished is logic for assigning a three-dimensional coordinate address, at uniform time intervals, for the informational input from each of the biological sources. Each of the display elements are energized in a fashion that is input-responsive to the coordinate addresses corresponding to the system inputs. The system is further provided with detectors for alerting the users to spatial and temporal coincidence of energized visual elements resultant from simultaneous inputting of like coordinate addresses by the biophysical source.

21 Claims, 5 Drawing Sheets

BIOPHYSICALLY CONTROLLED GAME SYSTEM

REFERENCE TO RELATED APPLICATION

This case is a continuation-in-part of application Ser. No. 07/087,526, filed Aug. 20, 1987 now abandoned, which is a continuation-in-part of application Ser. No. 06/646,818, filed Sep. 4, 1984, now abandoned.

BACKGROUND OF THE INVENTION

This invention relates to three-dimensional position indicators and, more particularly, to means for the assigning of three-dimensional coordinates to form a visual display of inputs having a biological origin.

Special purpose three-dimensional displays have been known in the prior art, and examples of the same appears in such patents as U.S. Pat. No. 3,636,551 to Maguire, entitled "Computer Controlled Three Dimensional Liquid Crystal Assembly Addressing System." Other related art includes U.S. Pat. No. 3,989,355 to Wilmer, entitled "Electro-Optic Display system"; U.S. Pat. No. 4,023,158 to Corcoran, entitled "Real Three-dimensional Vision Display Arrangement"; and U.S. Pat. No. 4,134,104 to Karras, entitled "Devices for Display Data in Three-Dimensions."

Other art of relevance are U.S. Pat. Nos. 4,086,514 (1978) and 4,754,202 (1987) both to Havel. Neither of these references teach the use of two spatially and electrically discrete sub-addresses at the same coordinate address. Such art does not provide for a three-dimensional optical matrix capable of simultaneously, and within the same geometry, displaying two or more inputs of biological origin in order to observe the spatial and temporal interaction between such biological originated inputs at the same coordinate location.

Applications of such a display can range from game applications, where one player simply attempts to catch a second player, to the use of such a display to "illustrate" human biological signals, such as EEGs, EMGs, galvanic skin responses, voice pitch, and the like.

In addition to applications as a three-dimensional chase game and a biofeedback monitor/game, the present inventive display may be used to "illustrate" isometric exercises, as a color organ, or as a light display for use in connection with stereos and other applications.

SUMMARY OF THE INVENTION

The present invention comprises a system for the simultaneous co-display at like sub-addresses of information emanating from two or more biophysical sources. A three-dimensional geometry of the display is defined by rigid and transparent structural members. Said members provide a multiplicity of visual display elements arranged throughout the geometry at regular coordinate addresses. Provided are information input terminals including means for biophysical interface therewith. Also furnished is appropriate software and hardware for assigning three-dimensional coordinate addresses, at uniform time-sample intervals, for the informational inputs from each biophysical source. The display elements are energized in a manner corresponding to the input-responsive coordinate addresses corresponding to the inputs.

It is an object of the present invention to provide a means for illustrating in three dimensions and within a constant geometry, two or more biological inputs.

It is a further object to provide means for simultaneous co-spatial and co-temporal visualization of two or more like classes of information but, however, derived from different sources.

The above and yet other objects and advantages of the present invention will become apparent from the hereinafter set forth Detailed Description of the Invention, the Drawings, and Claims appended herewith.

DETAILED DESCRIPTION OF THE INVENTION

Figure 1:
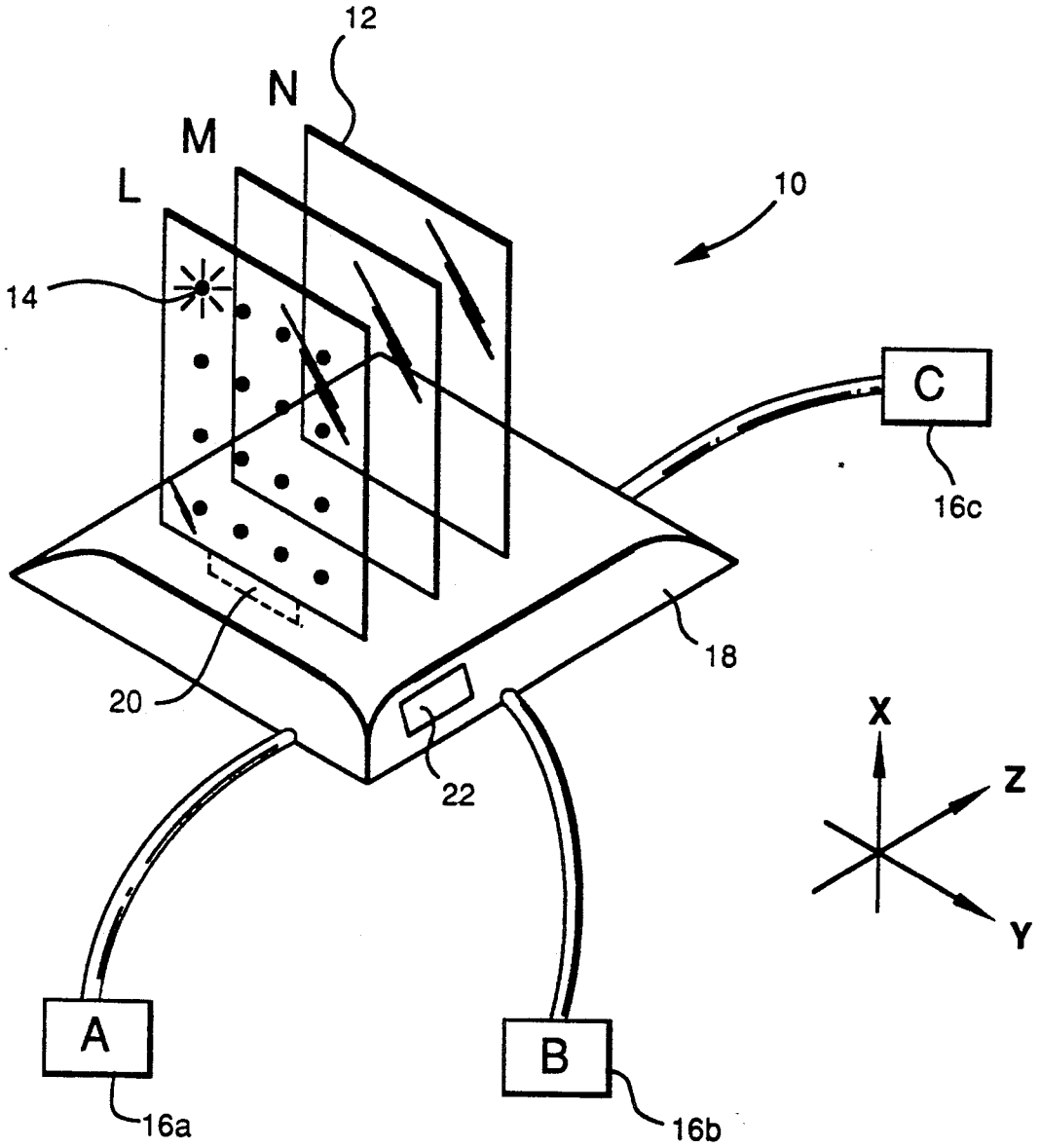
FIG. 1 is a perspective view of one embodiment of a three-dimensional display structure with matrix display elements located thereon, showing an X-Y-Z system of coordinate reference.

The within three-dimensional matrix optical display system may be the basis for numerous game and recreational applications.

Game control inputs 16 (see Blocks A, B and C in FIG. 1) define a plurality of input information terminals comprising means for biological interface therewith (later described in further detail).

The game control inputs 16 allow for X, Y and Z axis control over the position of an illuminated point within the gaming geometry 10. Such direct control is applicable where the present inventive display is used as a "joy-stick control" chase game. However, where the coordinate addresses are not directly derivable from a joy-stick type of input, an electronic address transform would, of necessity, be applied to each time-frame of biological input.

The three dimensional geometry 10 is defined by rigid and transparent structural members which, in a preferred embodiment, are in the form of a plurality of transparent plastic or glass cards 12, each providing a substrate for a two-dimensional array of light emitting diodes (LEDs) or optical fibers, as well as their interconnect circuitry which, through tongue 20, is plugged into a mother board base 18. The LED or optical fibers define a multiplicity of co-spatial visual display points 14 arranged throughout the three-dimensional geometry at regular coordinate addresses.

To assure visibility, the inter-connect circuitry of each card may comprise fine wire or indium tin oxide transparent electrodes.

To represent multiple players, several different colored LEDs may be provided at each coordinate address. In addition, the mother board base 18 may include a numerical display 22 to record game scores based upon the number of times of position coincidence of opponents in a chase game. As well, an audio generator may be employed to annunciate a "tag". More generically, there is provided means for detecting spatial and temporal coincidence of visual display points 14 energized during simultaneous inputting of like addresses from more than one biological input. Accordingly, the interconnect circuitry must include a means for energizing the visual display points 14 in accordance with the coordinate address generated directly at the input 16 or through electronic mathematical transformation of the biological input into a three-dimensional format.

Hardware variations of the display elements may include a single light source, using optical fibers having light-diffusing terminations, e.g., frosted plastic spheres to diffuse light. In this case, the joy-stick or electronic control signals would cause a mask with an optical aperture to move across the feed ends of a fiber optic bundle. Also, liquid crystals may be used for the visual display points 14.

It is noted that the display geometry 10 itself further comprise embedded intelligence enabling programmed input-actuated three-dimensional geometry of the display points 14. The player then would, in effect, be interacting with a programmed pattern at his game control input 16.

It is noted that through the use of various rod and connecter arrangements, geometries other than that shown in FIG. 1 may be obtained for the display.

Figure 2:
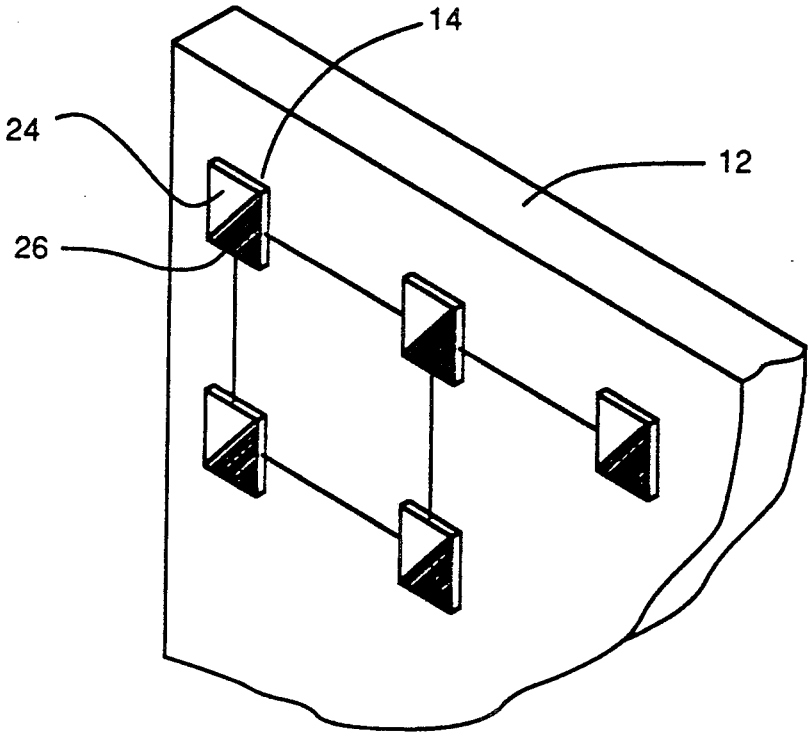
FIG. 2 is an enlarged view of the matrix display elements.

With reference to FIG. 2, it is noted that each display point 14 consists of two subgroups 24 and 26 which, in a preferred embodiment, will comprise light-emitting diodes (LEDs) of different colors, for example, green and red.

Figure 3:
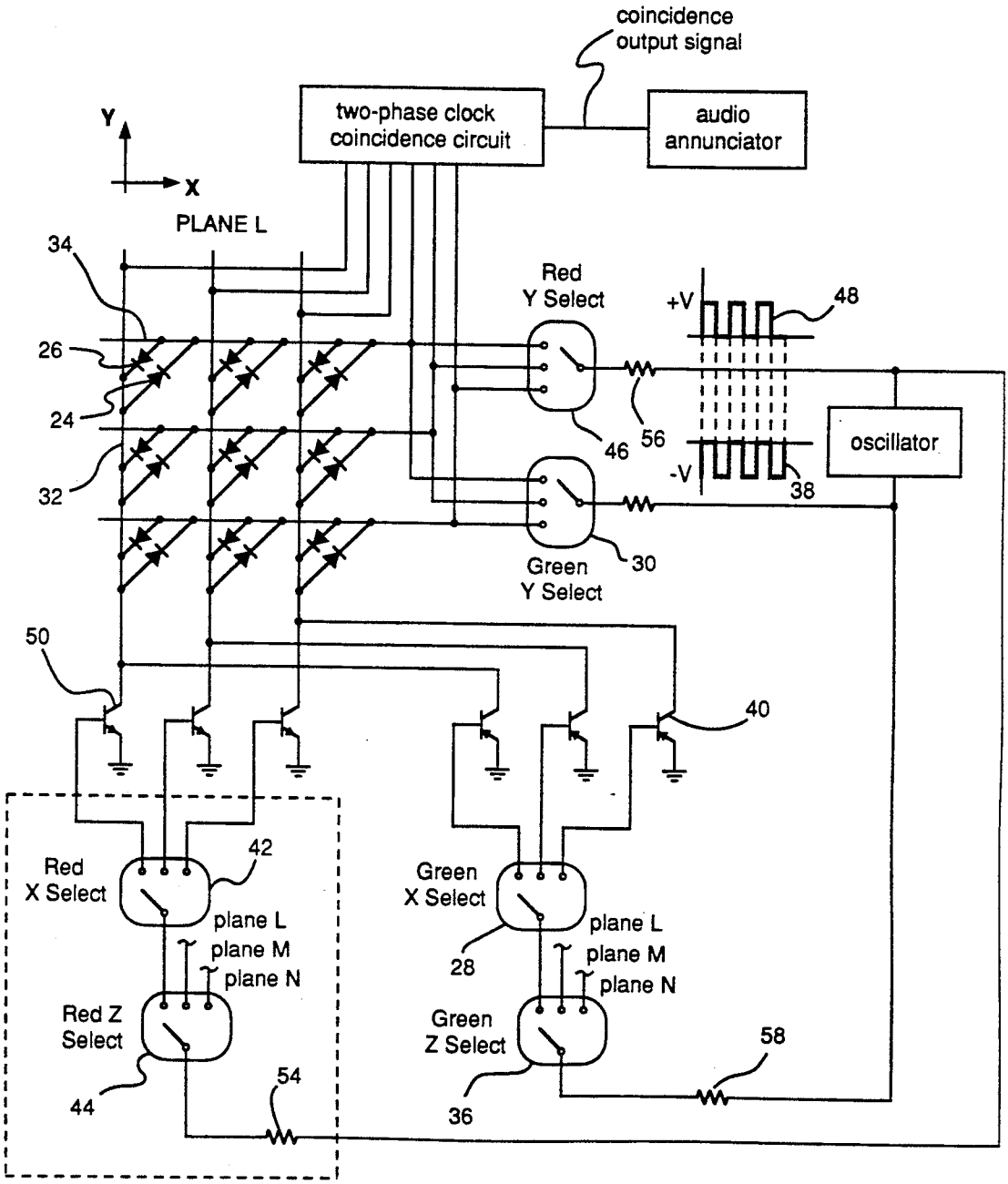
FIG. 3 is a circuit logic diagram of one embodiment of the system control logic.

FIG. 3 depicts a 3×3 array of green and red light emitting diode subgroups 24 and 26. As such, the circuit of FIG. 3 detects the presence of address pulses which are the same for both the red and green LEDs over the time period of successive oscillator clock cycles. This plane is designated, Plane L. It is one of three such planes 12 which form a cubic array of lights (in addition to Planes M and N). Each green Subgroup 24 within Plane L may be illuminated by electrically addressing it with "X" and "Y" joy-stick select switches 28 and 30 respectively. These switches will selectively connect one of the X address lines 32 and one of the Y address lines 34 to the electrical signals which cause illumination of a subgroup.

In the case of the green LEDs 24 it is to be noted that the X select switch 28 is placed in series with a Z select joy-stick select switch 36 which selects the desired plane. This switch-combination provides connection of a source of negative voltage pulses 38 to the base of one of p-n-p transistor switches 40. This transistor switch 40 is thereby turned on and connects the anode of the selected green LED to ground. At the same time the Y select switch 30 will address the LED by connecting its cathode to said source of negative voltage pulse 38. If the pulse rate is sufficiently high, flickerless illumination obtains.

Red LEDs 26 are energized analogously through switches 42, 44 and 46 In order to use the same address lines as for the green LEDs 24, the red LEDs are reversed in polarity relative to their green counterparts. They are addressed by positive pulses 48 which are time division multiplexed with the negative pulses 38 so that there is no electrical address line conflict between the green and red LED arrays.

For the red LEDs 26 joy-stick switch selectors 42 and 44 of n-p-n transistor switch 50, connect the transistor base to a positive pulse voltage so that the red LED cathode is grounded while joy-stick switch 52 connects the anode to a positive voltage. Resistors 54, 56, and 58 are current limiting resistors.

At present (1990), commercially available single packages contain red and green LEDs connected in the manner shown (anode-to-cathode) in FIG. 3. If both LEDs are addressed in the proposed time division multiplexed manner, an orange light results. This would visually annunciate a tag.

It is to be noted that the geometry of the inventive display system may take several forms. For example, the rigid and transparent structural members shown in FIG. 1 may comprise modular elements capable of re-orientation into differing geometries.

Figure 4:
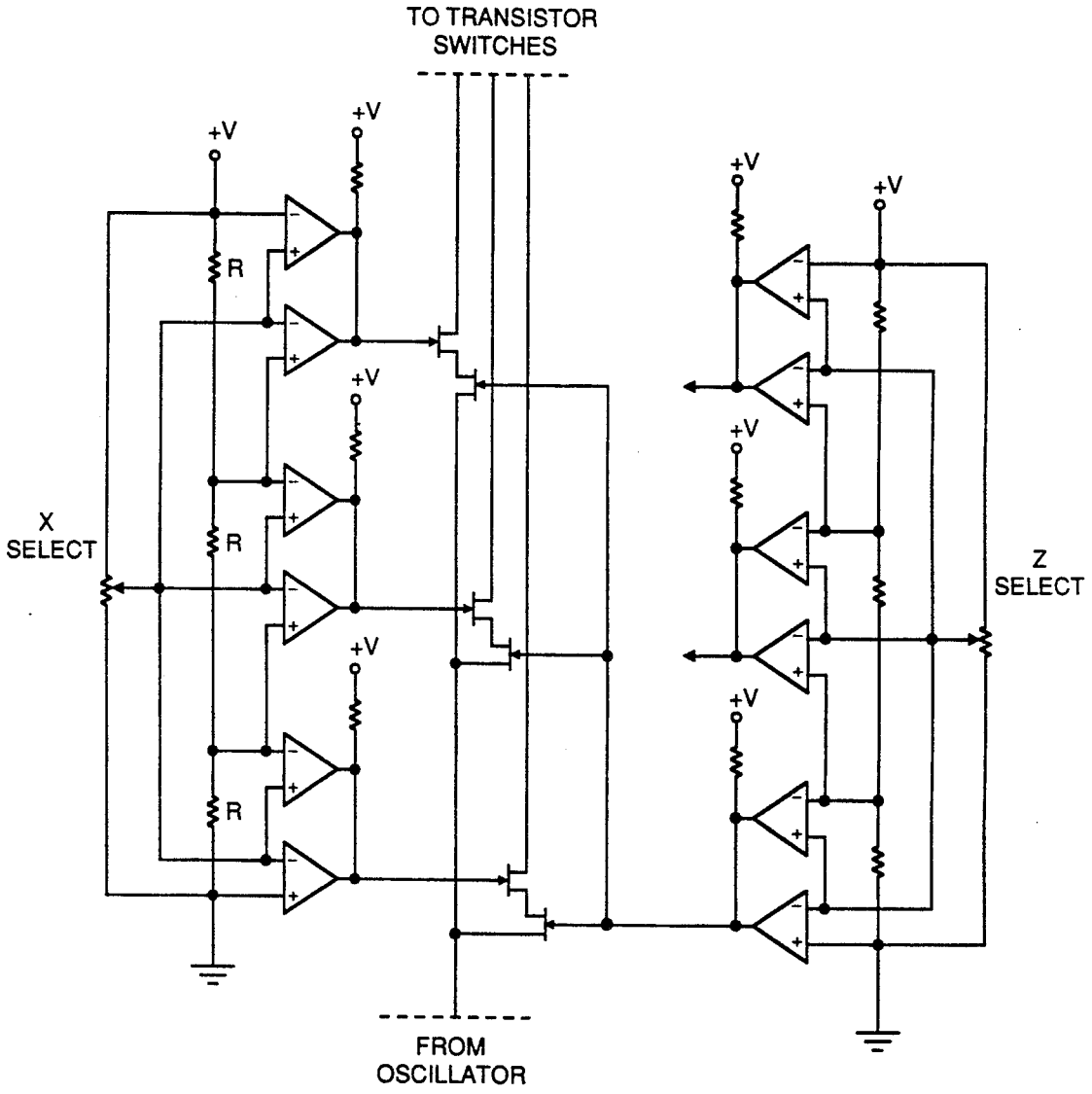
FIG. 4 is a circuit logic diagram of an alternate embodiment of the control logic.

FIG. 4 shows an alternate implementation of the switching function contained within the dotted lines of FIG. 3.

Figure 5:
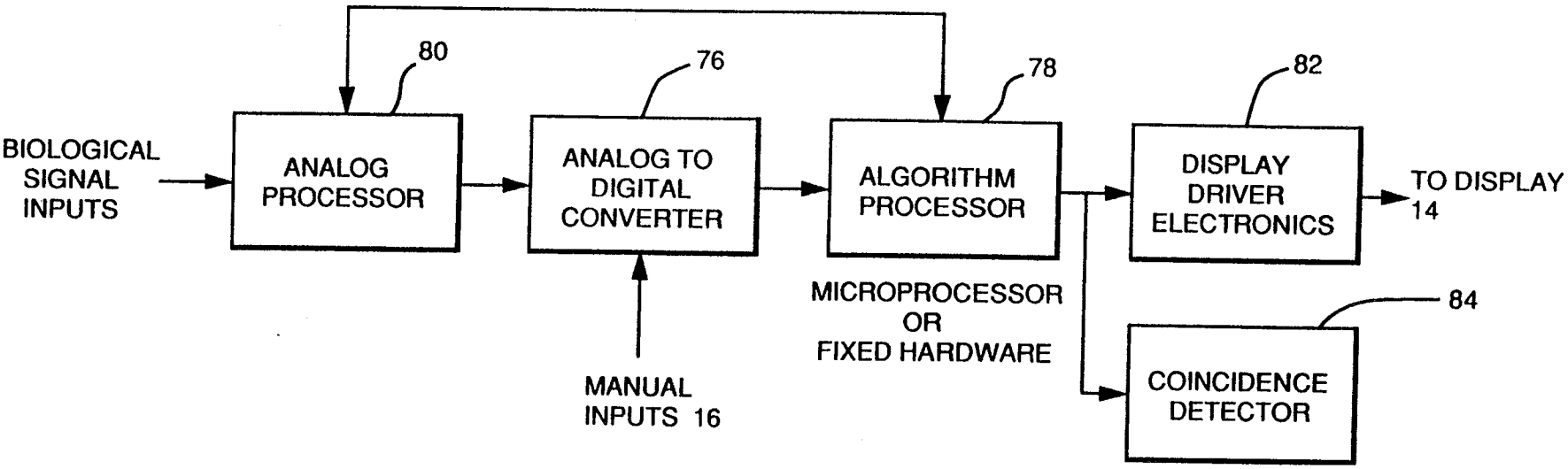
FIG. 5 is a conceptual representation of a microprocessor controlled embodiment of the present invention.

With reference to FIG. 5, a general system diagram is shown. Therein, the biological signals comprising the outputs of an analog processor 80 may perform such functions as wave form peak detection, band pass filtering and, in the most general case, may be adaptive, that is, may be caused to vary the ways in which it processes the inputs signals.

The analog wave forms and/or parameters which result from this process then enter an analog to digital converter 76 in which time domain samples of wave forms or wave form parameters are converted to digital electronic representations. This digital data may then be operated on by an algorithm which may be either resident in software, resident in a microprocessor, or may comprise a fixed hardware implementation. In any case, this function is represented by an algorithm processor 78 shown in FIG. 5. Thereupon, the algorithm can call for modification by the proceeding analog processor 80 via a feedback control path to the processor 80 which path is shown in FIG. 5. For example, based upon data it receives, the algorithm processor 78 may call for a decreasing band with a particular filter in the analog processor 80.

The algorithm essentially performs a mapping function to convert the input data received from the analog-to-digital converter 76 into time dependent three-dimensional coordinates. Thus, the output of the algorithm processor 80 comprises one or more channels of a time series of coordinates which are fed to display drive electronics 82 which sequentially display these coordinates by appropriately illuminating the three-dimensional, discrete sub-addresses of each coordinate address of each display group. In the case of multiple channels of display, that is, when there is more than one signal displayed, a coincidence detector 84 will determine if the same three dimensional coordinates have been addressed at the same time by different channels.

The game control inputs 16 allow for a more direct control of the display. An example of this would comprise the use of joy sticks and slide switches to control the X, Y and Z positions of an illuminated sub-address. Said signals would thereby allow display of inputs of multiple users who may act as opponents in a gaming application.

Such inputs must be mapped into the X, Y and Z coordinates of the system of the above described. One or more biological signals may be operated upon. For example, in a single input, an algorithm may map the average value of the amplitude of the associated biological waveform into the X coordinate, the peak value of the frequency content into the Y coordinate, and the maximum amplitude into the Z coordinate. When such multiple signals are input, a single characteristic parameter or mix of parameters of these separate wave forms, such as would be the case in an EEG alpha wave, voice sound, or skin impedance, may be used. Such signals can be scaled and/or in other ways combined to generate various X, Y and Z coordinates. Manual and other biological signals can be so combined and the algorithm may operate upon the domain characteristics of the input signal or, by analog or digital filtering, may provide for spectral decomposition and frequency domain operation. Further, such an algorithm may be predictive, that is, predicting the next data point using such techniques as an auto-regressive moving average.

Accordingly, while there have been shown and described the preferred embodiment of the present invention, it will be understood that the invention may be embodied otherwise than is herein specifically illustrated or described and that within said embodiment certain changes in the detail and construction, and in the form of arrangement of parts may be made without departing from the underlying idea or principles of this invention within the scope of the appended claims.

Having thus described our invention, what we claim as new, useful and non-obvious and, accordingly, secure by Letters Patent of the United States is:

1. A game system providing visual depiction of coordinate information derived from the inputs of at least two players, said visual depiction of coordinate information comprising the illumination of particular light sources within a spatial distribution of light sources, visual feedback from said depiction allowing said players to modify their inputs to achieve game objectives, said game objectives associated with achieving specific geometric relationships of said illuminated light sources, said game system comprising:

a) a three-dimensional geometry defined by rigid structural support;

b) a three-dimensional distribution of light sources supported by said rigid structural support, each individual said light source electrically addressable by said inputs of all said players, each said light source emanating a distinct color of light when addressed by each distinct said player input;

c) game input means operable by each said player, whereby a said player causes the illumination of specific said light sources within said three-dimensional distribution of light sources;

d) electrical means for addressing said light sources by said game input means;

e) electrical means for energizing said addressed light sources.

2. A game system as recited in claim 1 which includes electronic means for detection of temporally coincident addressing of each of said light sources by the said inputs of a multiplicity of said players.

3. A game system as recited in claim 1 wherein provision is included for said light sources to remain continuously illuminated after having been addressed.

4. A game system as recited in claim 3 wherein said game input means control both the illumination and the extinguishing of subsets of light sources within said three-dimensional distribution of light sources.

5. A game system as recited in claim 1 which includes electronic scoring means.

6. A game system as recited in claim 5 wherein said electronic scoring means monitors the addressing of said light sources by competing said players, establishes scoring based on geometric game rules and annunciates score.

7. A game system as recited in claim 1 which includes means to audibly annunciate the scoring of players.

8. A game system as recited in claim 1 which includes means for visually displaying scoring information.

9. A game system as recited in claim 1 in which said electronic means for addressing said light sources includes means for altering the way in which inputs are mapped to coordinate addresses both before and after commencement of player competition, said alternation of mapping thereby creating requirement for competing said players to relearn operation of said game input means.

10. A game system as recited in claim 1 wherein said game input means comprise physical actuation means.

11. A game system as recited in claim 10 wherein said physical actuation means comprise a combination of joysticks and switches.

12. A game system as recited in claim 1 wherein said game input means comprise voice sounds detection means.

13. A game system as recited in claim 1 wherein said game input means comprise a combination of physical actuation means and voice sounds detection means.

14. A game system as recited in claim 1 wherein at least one said player input is computer-generated, said computer-generated input applied directly to said electrical addressing means, said computer-generated input responsive to input of other said players.

15. A game system as recited in claim 1 wherein said game system is computer-controlled, said computer control causing to be illuminated a group of said light sources to form a maze within said three-dimensional distribution of light sources, said maze navigated by said players by player sequential illumination of specific said light sources confined within said maze geometry.

16. A game system as claimed in claim 1 wherein said game system is computer-controlled, said computer control allowing said light sources to be illuminated by said game inputs in accordance with game rules.

17. A game system as recited in claim 1 wherein each said light source comprises at least two light-emitting elements each emanating light of different color, each said light-emitting element having two electrical terminals and emanating light when electrically energized with electricity of specific polarity applied to said terminals, each said light source further having said light-emitting elements in close physical proximity and electrically connected in parallel with opposite polarities, said electronic means for energizing said light sources including time-division-multiplexing of electrical power pulses of opposite polarity to electrical connections to said light sources in order to achieve said emanating of multiple distinct colors of light from said light sources using two electrical connections for each said light source, said electrical addressing of said light source by a particular player input causing said electrical power pulses of polarity corresponding to said particular player to be connected to said addressed light source.

18. A game system as recited in claim 1 wherein it is visually apparent that a multiplicity of said light sources are illuminated, said visually apparent illumination of a multiplicity of light sources achieved by time-division-multiplexed addressing of said multiplicity of light sources.

19. A game system as claimed in claim 1 wherein said three-dimensional distribution of light sources is arranged along three-dimensional coordinate axes, said three-dimensional coordinate axes comprising a three-dimensional coordinate system, said game input means corresponding to coordinate addressing of said light sources in said three-dimensional coordinate system.

20. A method of providing player game interaction in a three-dimensional space comprising:

a) accepting initial player inputs through game input devices;

b) converting said player inputs to electrical addresses of light sources arranged in a three-dimensional geometry; said addressed light source having a correspondance to each of said player inputs, c) energizing said addressed light sources and causing each said energized light source to emanate a distinct color of light corresponding to addressing by said input from each distinct said player;

d) accepting through said game input devices player inputs subsequent to said initial player inputs, determination of said subsequent player inputs based upon visual feedback afforded said players by said addressed light sources, accuracy of said player inputs and game goals for establishing geometric relationships among said addressed light sources.

21. A method as recited in claim 20 which includes detecting the temporal addressing of each of said light sources by the said inputs of a multiplicity of said players.

* * * * *